US010186768B2

(12) United States Patent
Lewis

(10) Patent No.: US 10,186,768 B2
(45) Date of Patent: Jan. 22, 2019

(54) DIPOLE ANTENNA ARRAY

(71) Applicant: BAE SYSTEMS plc, London (GB)

(72) Inventor: Gareth Michael Lewis, Chelmsford (GB)

(73) Assignee: BAE Systems plc, London (GB)

( * ) Notice: Subject to any disclaimer, the term of this patent is extended or adjusted under 35 U.S.C. 154(b) by 128 days.

(21) Appl. No.: 14/762,693

(22) PCT Filed: Jan. 22, 2014

(86) PCT No.: PCT/GB2014/050171
§ 371 (c)(1),
(2) Date: Jul. 22, 2015

(87) PCT Pub. No.: WO2014/114932
PCT Pub. Date: Jul. 31, 2014

(65) Prior Publication Data

US 2015/0372377 A1 Dec. 24, 2015

(30) Foreign Application Priority Data

Jan. 25, 2013 (EP) ..... 13275016
Jan. 25, 2013 (GB) ..... 1301338.8

(51) Int. Cl.
*H01Q 9/16* (2006.01)
*H01Q 1/50* (2006.01)
(Continued)

(52) U.S. Cl.
CPC ..... *H01Q 1/50* (2013.01); *H01Q 1/48* (2013.01); *H01Q 1/523* (2013.01); *H01Q 9/16* (2013.01);
(Continued)

(58) Field of Classification Search
CPC ..... H01Q 1/246; H01Q 21/062; H01Q 21/24; H01Q 21/26; H01Q 21/067; H01Q 25/001;
(Continued)

(56) References Cited

U.S. PATENT DOCUMENTS 3,784,933 A 1/1974 Scherer et al.
3,845,490 A * 10/1974 Manwarren ..... H01P 5/1007 333/238
(Continued)

FOREIGN PATENT DOCUMENTS

DE 2020192 A1 11/1971
EP 1229605 A1 8/2002
(Continued)

OTHER PUBLICATIONS

Radio Frequency Circuit Design, 2nd edition by W. Alan Davis, May 2010.*
(Continued)

*Primary Examiner* — Hoang Nguyen
*Assistant Examiner* — Awat Salih
(74) *Attorney, Agent, or Firm* — Finch & Maloney PLLC

(57) ABSTRACT

According to the invention there is provided a dipole antenna array including at least one dipole antenna sub-array, wherein the dipole antenna sub-array includes a plurality of co-planar antenna units, each antenna unit including a pair of dipole radiating elements and a balun having an output line for providing output electrical signals to the pair of dipole radiating elements.

22 Claims, 7 Drawing Sheets

(51) Int. Cl.

| | |
|---|---|
| ***H01Q 1/52*** | (2006.01) |
| ***H01Q 9/28*** | (2006.01) |
| ***H01Q 21/06*** | (2006.01) |
| ***H01Q 1/48*** | (2006.01) |
| ***H01Q 21/00*** | (2006.01) |

(52) U.S. Cl.
CPC ..... *H01Q 9/285* (2013.01); *H01Q 21/00* (2013.01); *H01Q 21/062* (2013.01)

(58) Field of Classification Search
CPC ..... H01Q 5/48; H01Q 9/16; H01Q 9/065; H01Q 9/265; H01Q 9/285; H01Q 19/13; H01Q 19/108; H01Q 21/065
See application file for complete search history.

(56) References Cited

U.S. PATENT DOCUMENTS

| | | | | |
|---|---|---|---|---|
| 4,097,868 | A * | 6/1978 | Borowick | H01Q 1/08 343/727 |
| 4,287,518 | A * | 9/1981 | Frosch | H01Q 9/065 343/700 MS |
| 4,686,536 | A * | 8/1987 | Allcock | H01Q 9/065 343/700 MS |
| 4,800,393 | A * | 1/1989 | Edward | H01Q 9/065 333/26 |
| 5,952,983 | A * | 9/1999 | Dearnley | H01Q 1/246 343/797 |
| 6,166,701 | A | 12/2000 | Park et al. | |
| 6,342,867 | B1 * | 1/2002 | Bell | H01Q 19/108 343/795 |
| 6,891,446 | B2 * | 5/2005 | Tayrani | H01P 5/10 333/1.1 |
| 6,949,978 | B2 * | 9/2005 | Tayrani | H03F 1/565 330/207 A |
| 7,642,980 | B2 * | 1/2010 | Louzir | H01Q 9/045 343/767 |
| 8,242,966 | B2 * | 8/2012 | Liu | H01Q 9/285 343/795 |
| 8,325,099 | B2 * | 12/2012 | Cavener | H01P 5/1007 343/767 |
| 8,648,759 | B2 * | 2/2014 | Wang | H01Q 1/286 343/700 MS |
| 2001/0043128 | A1 | 11/2001 | Lo | |
| 2002/0149440 | A1 | 10/2002 | Deckman | |
| 2003/0193377 | A1 * | 10/2003 | Quan | H01P 1/127 333/164 |
| 2006/0273865 | A1 * | 12/2006 | Timofeev | H01Q 1/246 333/161 |
| 2007/0222696 | A1 * | 9/2007 | Wikstrom | H01Q 1/38 343/797 |
| 2009/0122847 | A1 * | 5/2009 | Nysen | H01Q 1/38 375/222 |
| 2009/0124215 | A1 * | 5/2009 | Nysen | H01Q 1/2275 455/90.1 |
| 2010/0271280 | A1 * | 10/2010 | Pickles | H01Q 9/16 343/858 |
| 2011/0291907 | A1 * | 12/2011 | Puzella | H01P 5/10 343/816 |
| 2012/0025848 | A1 * | 2/2012 | Hasch | B23D 59/005 324/640 |
| 2012/0062433 | A1 * | 3/2012 | Balanis | H01Q 1/38 343/720 |
| 2012/0218156 | A1 * | 8/2012 | Mohammadian | H01Q 1/241 343/730 |
| 2013/0169505 | A1 * | 7/2013 | Shmuel | H01Q 1/088 343/848 |
| 2013/0214982 | A1 * | 8/2013 | Dean | H01Q 9/285 343/795 |
| 2014/0009347 | A1 * | 1/2014 | Bertin | H01Q 1/2258 343/725 |

FOREIGN PATENT DOCUMENTS

| | | | |
|---|---|---|---|
| GB | 2338346 | A | 12/1999 |
| WO | 9927611 | | 6/1999 |
| WO | 2005112196 | A1 | 11/2005 |
| WO | 2010142756 | A1 | 12/2010 |
| WO | 2014114932 | A1 | 7/2014 |

OTHER PUBLICATIONS

International Preliminary Report on Patentability and Written Opinion received for Patent Application No. PCT/GB2014/050171, dated Aug. 6, 2015. 6 pages.
International Search Report and Written Opinion received for Patent Application No. PCT/GB2014/050171, dated Feb. 20, 2014. 10 pages.
GB Intellectual Property Office Search Report under Section 17(5) received for GB Patent Application No. 1301338.8 dated May 22, 2013. 4 pages.
Extended European Search Report received for EP Application No. 13275016.7, dated Jun. 6, 2013. 8 pages.
Bialkowski, M.E. and Abbosh, A.M., "Design of a Compact UWB Out-of-Phase Power Divider," IEEE Microwave and Wireless Components Letters, vol. 17, No. 4. Apr. 2007. 3 pages.
Evtioushkine, et. al., Very wideband printed dipole antenna array, Electronic Letters, vol. 34, No. 24, Nov. 26, 1998. pp. 2292-2293.

* cited by examiner

Dual-Polarised Antenna Assembly

Linearly Polarised Array with Slotted Ground Plane

Dual-Polarised Board Type 1 (Lower Slots)

DIPOLE ANTENNA ARRAY

This invention relates to a dipole antenna array, with particular reference to dipole antenna arrays which include a variety of antenna units which themselves include a pair of dipole radiating elements and a balun.

The use of the Highly-Coupled Dipole (HCD) as a radiating element for multi-function array antennas promises a great deal in terms of bandwidth and polarisation properties. However, to provide a practical implementation, it would be desirable to improve upon the current complexity of construction. Furthermore, it is desirable to provide an array which can operate over a wide frequency range.

The present invention, in at least some of its embodiments, addresses one or more of the above described problems and desires.

According to the invention there is provided a dipole antenna array including at least one dipole antenna sub-array, wherein the dipole antenna sub-array includes a plurality of co-planar antenna units, each antenna unit including a pair of dipole radiating elements and a balun having an input line for providing output electrical signals to the pair of dipole radiating elements.

In some embodiments, adjacent co-planar antenna units have adjacent dipole radiating elements which are spaced apart.

In other embodiments, adjacent co-planar antenna units have adjacent dipole radiating elements which overlap.

Typically, each dipole antenna sub-array is a monolithic structure, ie, a co-planar, plank style arrangement such as a board. Typically the pair of dipole antenna radiating elements is supported at the monolithic structure so as to be co-planar (or at least parallel) with a plane defined by the monolithic structure.

The dipole antenna sub-array may have a first face and a second face. At least two consecutive antenna units may each have a dipole radiating element on both the first and second faces. Typically, in these embodiments, all of the antenna units in the dipole sub-array have a dipole radiating element on both the first and second faces. In some embodiments, the consecutive antenna units are arranged so that a dipole radiating element on the first face of one of said consecutive antenna units is adjacent a dipole radiating element on the second face of the next one of said consecutive antenna units. Advantageously, the consecutive antenna units are arranged so that a dipole radiating element on the first face of one of said consecutive antenna units overlaps the adjacent dipole radiating element on the second face of the next one of said consecutive antenna units. In this way, an arrangement can be provided in which adjacent co-planar antenna units have adjacent dipole radiating elements which overlap.

A dipole antenna array may further include a ground plane having at least one slot form therein, wherein a dipole antenna sub-array extends through the slot. A linearly polarised dipole antenna array may be provided which includes a plurality of dipole antenna sub-arrays, in which the ground plane includes a plurality of parallel slots formed therein, and the dipole antenna sub-arrays extend through the slots so that the dipole antenna sub-arrays are in a parallel arrangement.

In some embodiments, a dual polarised dipole antenna array is provided which includes at least first and second dipole antenna sub-arrays which are in a mutually orthogonal arrangement. The first and second dipole antenna sub-arrays may be separate elements which are conjoined together in a mutually orthogonal arrangement. A first and second dipole antenna sub-array may be slotted together in the mutually orthogonal arrangement using a plurality of slots formed in at least one of the first and second dipole antenna sub-arrays. Preferably, slots are formed in both of the first and second dipole antenna sub-arrays for this purpose. In some embodiments, the first dipole antenna sub-array has slots formed therein, in which each slot extends between the dipole radiating elements of an antenna unit. Preferably, each antenna unit which has a slot extending between its dipole radiating elements has its balun arranged so that at least the output line is inclined with respect to the slot. With these arrangements it is relatively easy to provide substantially equal path lengths for the output lines leading to each dipole radiating element.

Typically, the baluns each include a slotline which is coupled to an input line and the output line. In some embodiments, the baluns further include: an input port for receiving the input electrical signal, a first output port and a second output port; wherein the output line has a junction with a slotline;

in which: the input line couples the input electrical signal to the slotline; the slotline couples the input electrical signal to the junction, the junction acting as a divider to produce first and second output electrical signals; and the output line couples the first and second output electrical signals to, respectively, the first output port and the second output port. Baluns of this type are known from US 2005/0105637, Bialkowski & Abbosh (M E Bialkowski and A M Abbosh, IEEE Microwave and Wireless Components Letters, Vol. 17, No. 4, April 2007), and our UK patent applications numbers GB1210817.1 and GB1210816.3, the contents of all of which are herein incorporated by reference. It is known from these documents how to implement baluns using microwave techniques involving microstrips and slotlines. Features such as open circuit or short circuit terminations may be incorporated into the baluns as is known in the art.

Typically, at least one of the input line and the output line is a microstrip or a stripline. Preferably, both of the input line and the output line are microstrips or striplines.

Advantageously, the dipole antenna array is in the form of a printed circuit board (PCB). The dipole antenna array may be in the form of a microwave laminate structure.

The dipole antenna sub-arrays may have a plurality of plated through holes (vias) formed therein. The vias are disposed so as to suppress parallel plate modes, typically parallel plate modes that can be excited between the two ground plane layers of the stripline.

The dipole radiating elements can be of any suitable design. In some embodiments, the dipole radiating elements are of a bow tie arrangement.

Whilst the invention has been described above, it extends to any inventive combination or sub-combination of the features set out above, or in the following description, drawings or claims.

Embodiments of dipole antenna arrays in accordance with the invention will now be described with reference to the accompanying drawings, in which:—

Figure 1A:
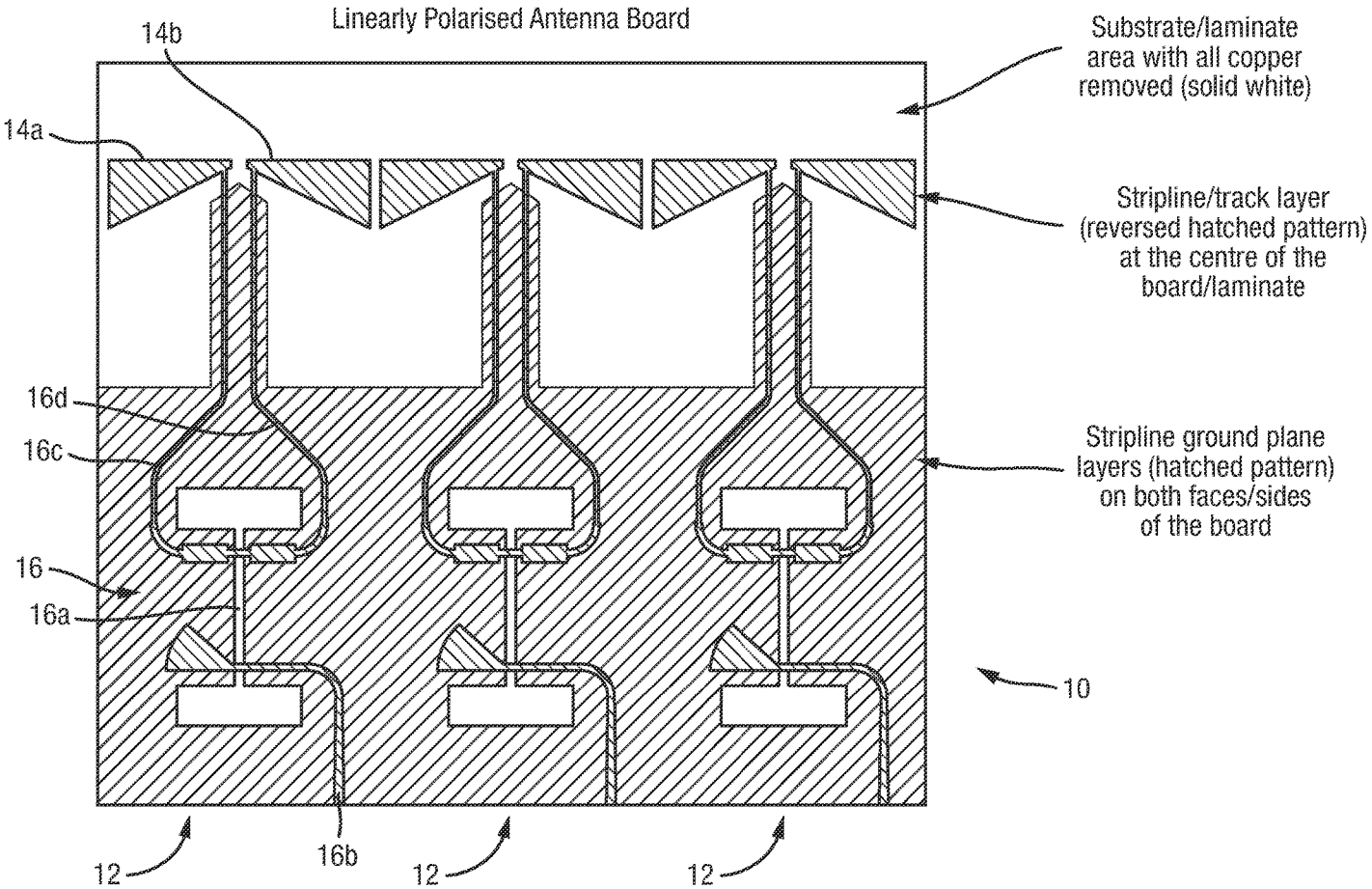
FIG. 1 shows (*a*) a front view of a dipole antenna sub-array and (*b*) a perspective view of a dual-polarised dipole antenna array.
Figure 1B:
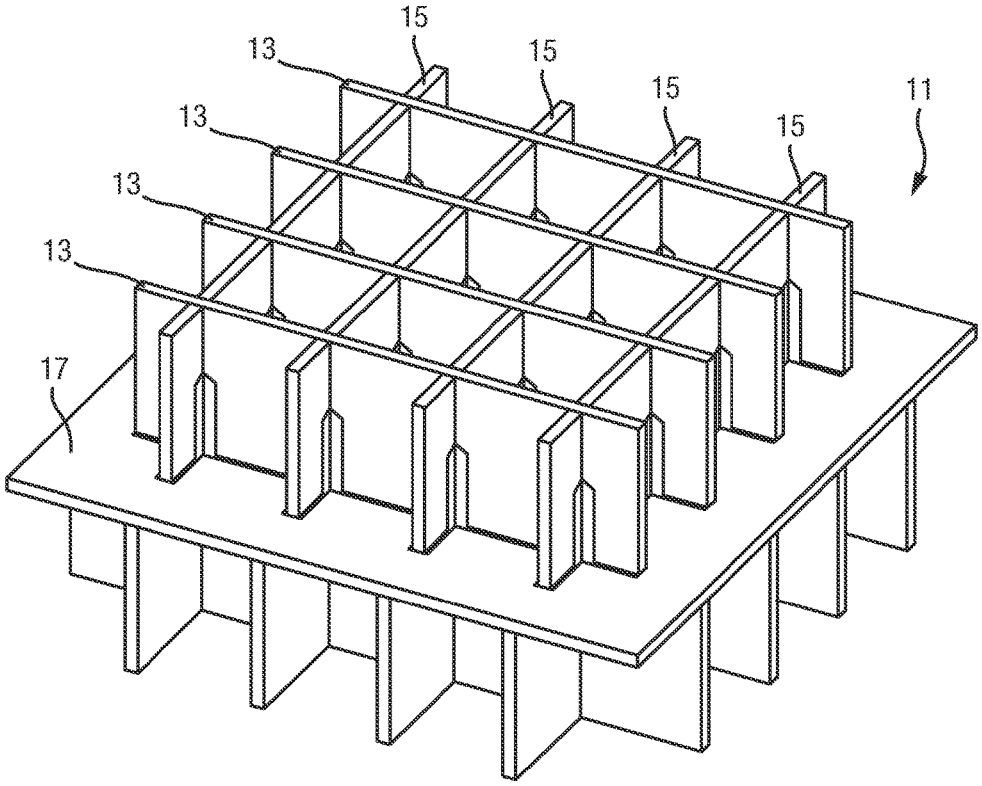

FIG. 1 (*a*) shows an antenna array, depicted generally at 10, which includes a plurality of co-planar antenna units 12. Each antenna unit 12 includes a pair of dipole radiating elements 14(*a*), 14(*b*) which are of the bow tie type. Each antenna unit 12 further comprises a balun 16. The design of the balun can be of any convenient type. In the example shown in FIG. 1(*a*) the balun has a slotline 16(*a*) which is in communication with an input line 16(*b*) and an output line. The output line comprises first and second output arms 16(*c*), 16(*d*). Each output arm 16(*c*), 16(*d*) has an output port which is in direct communication with one of the pair of dipole radiating elements 14(*a*), 14(*b*). Conveniently, the antenna sub-array 10 is manufactured using a microwave laminate structure which houses all of the antenna units 12. These structures can comprise a conductive central track layer sandwiched between two dielectric layers. Conductive layers such as copper layers may be present on the outside of the dielectric layers. In FIG. 1(*a*) areas shown in solid white represent a substrate/laminate area with all copper removed, and areas in solid black represent stripline/track layer areas located at the centre of the laminate structure. The hash pattern denotes copper stripline ground plane layers on both faces of the laminate structure. In general, constructional techniques known to produce tapered slot antenna arrays can be used or adapted to construct linearly or dual-polarised dipole antenna arrays of the invention.

Figure 2:
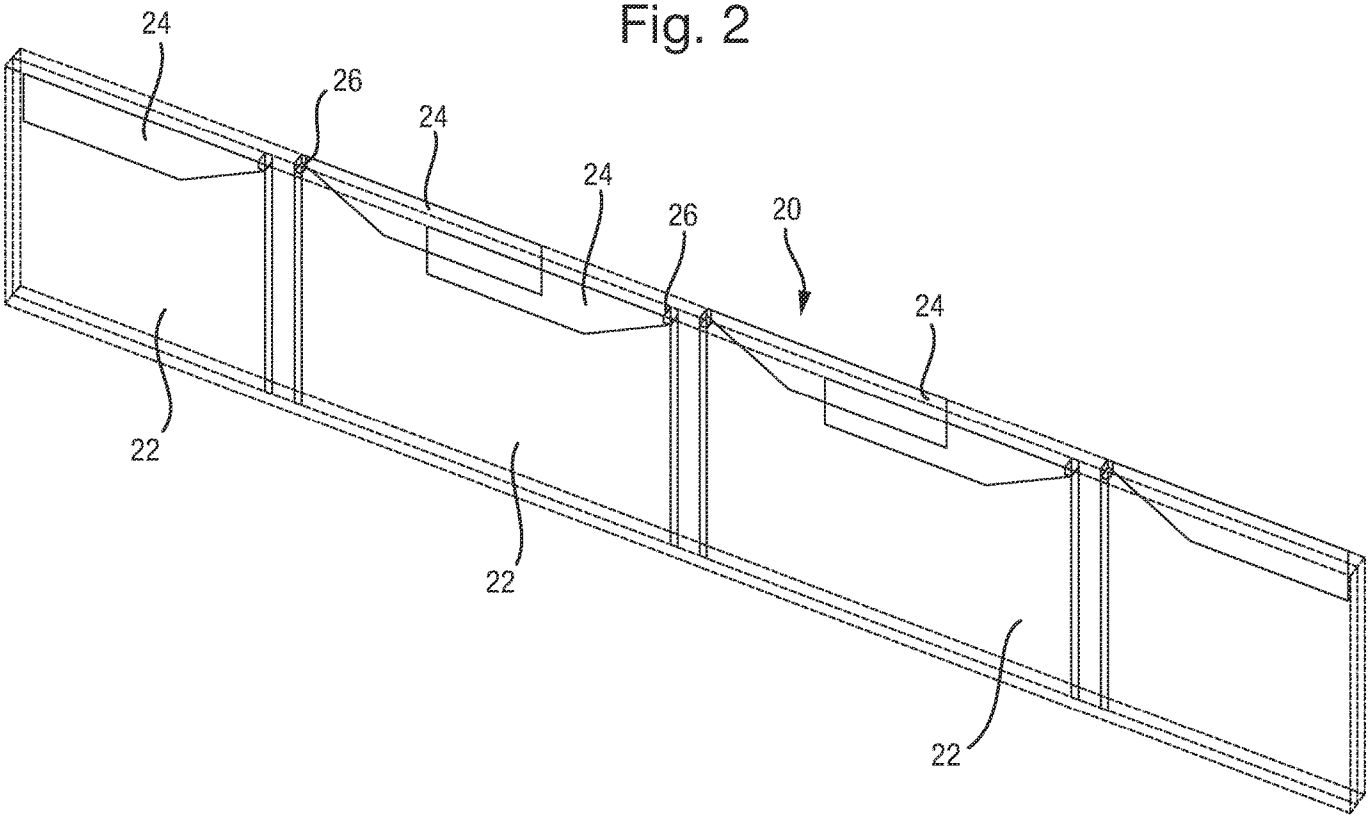
FIG. 2 is a perspective view of a dipole antenna sub-array.

FIG. 2 shows a gang-buster style arrangement 20 for a dipole antenna sub-array. The dipole antenna sub-array 20 comprises individual antenna units 22. For ease of reference, the baluns associated with each of the antenna units 22 are not shown in FIG. 2. Each antenna unit 22 includes dipole arms 24. In the embodiment shown in FIG. 2 the dipole arms are placed on the exterior ground plane layers. Plated through holes 26 are provided to connect the dipole arms 24 to the stripline track (not shown) in the centre of the board/laminate triplate. By placing one dipole arm of an antenna unit on one side of the laminate and the other dipole arm on the opposite side, a gang-buster style arrangement can be achieved. This allows the dipole arms to be longer than the spacing of the antenna units, potentially offering benefits in terms of operating bandwidth. In another embodiment, the dipole arms are placed on all three layers in the triplate laminate, with connections being made by plated through holes. This may improve bandwidth. Another option still is to position the dipole arms on the central track layer, thereby avoiding the need to use plated through holes.

Figure 3:
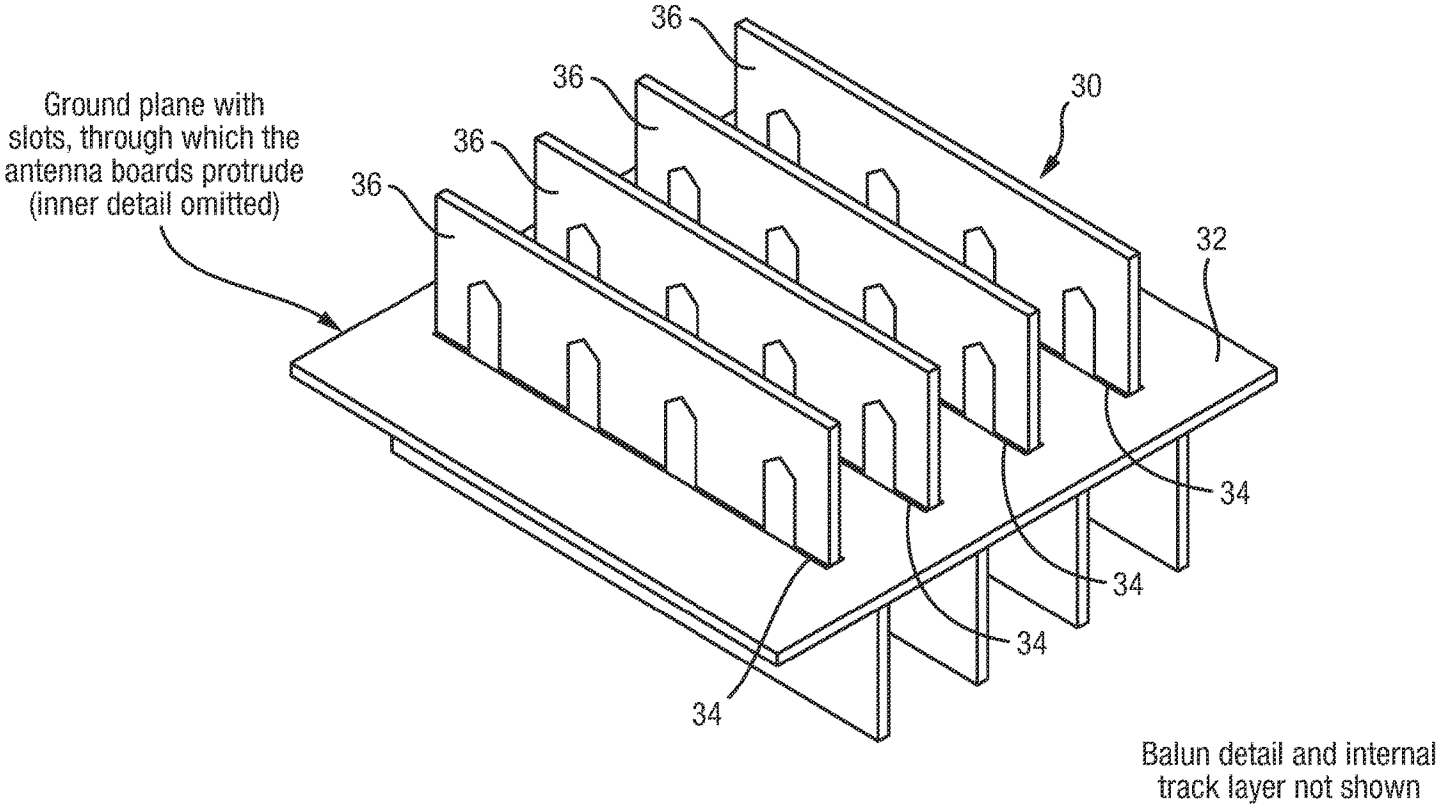
FIG. 3 is a perspective view of a linearly polarised dipole antenna array with a ground plane.

FIG. 3 shows a linearly polarised dipole antenna array 30 which comprises a ground plane 32 having a plurality of slots 34 formed therein. An antenna sub-array 36 protrudes through each of the slots 34.

Figure 4A:
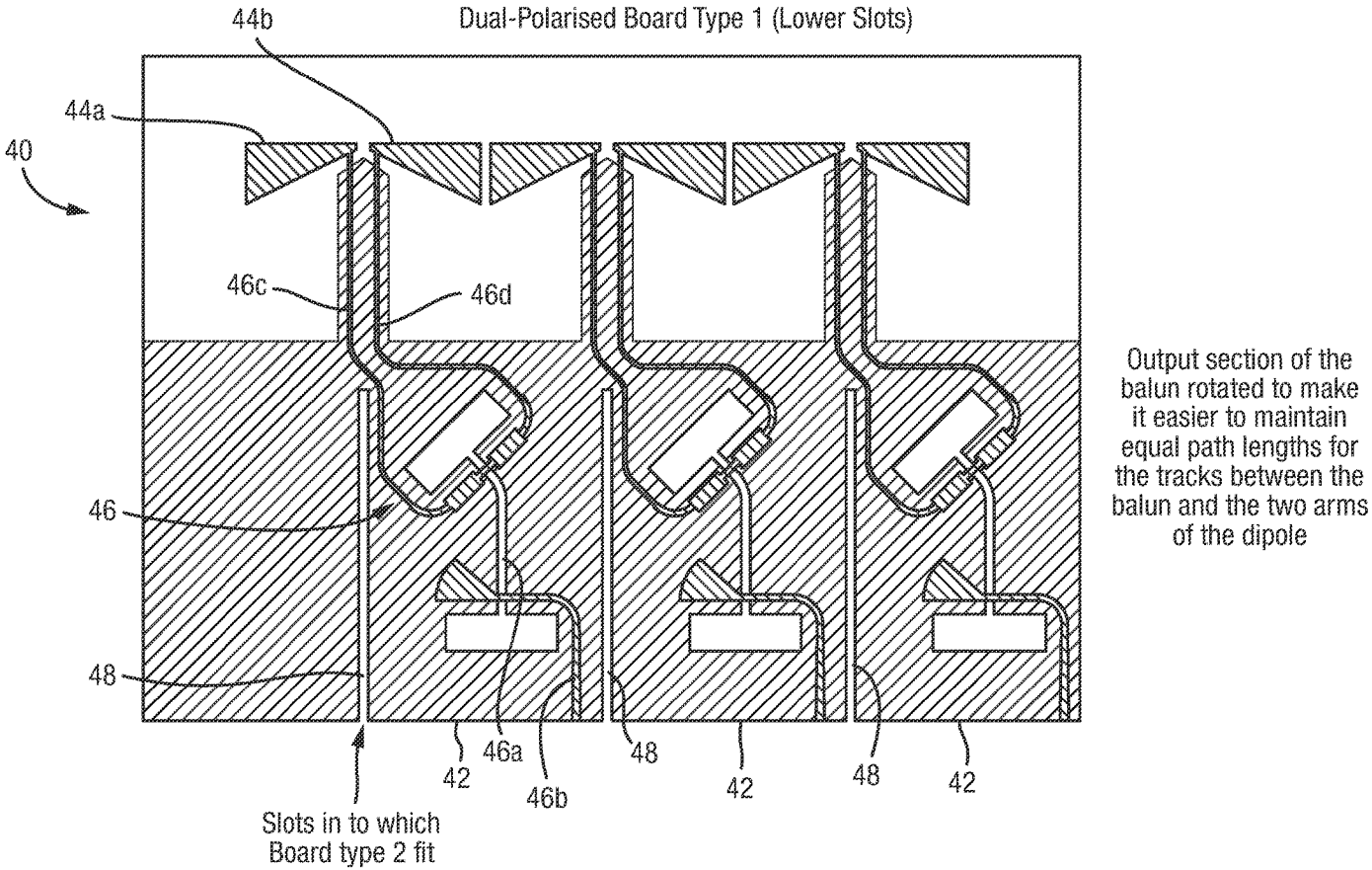
FIG. 4 shows (*a*) a first dipole antenna sub-array and (*b*) a second dipole antenna sub-array for use in a dual-polarised antenna array.
Figure 4B:
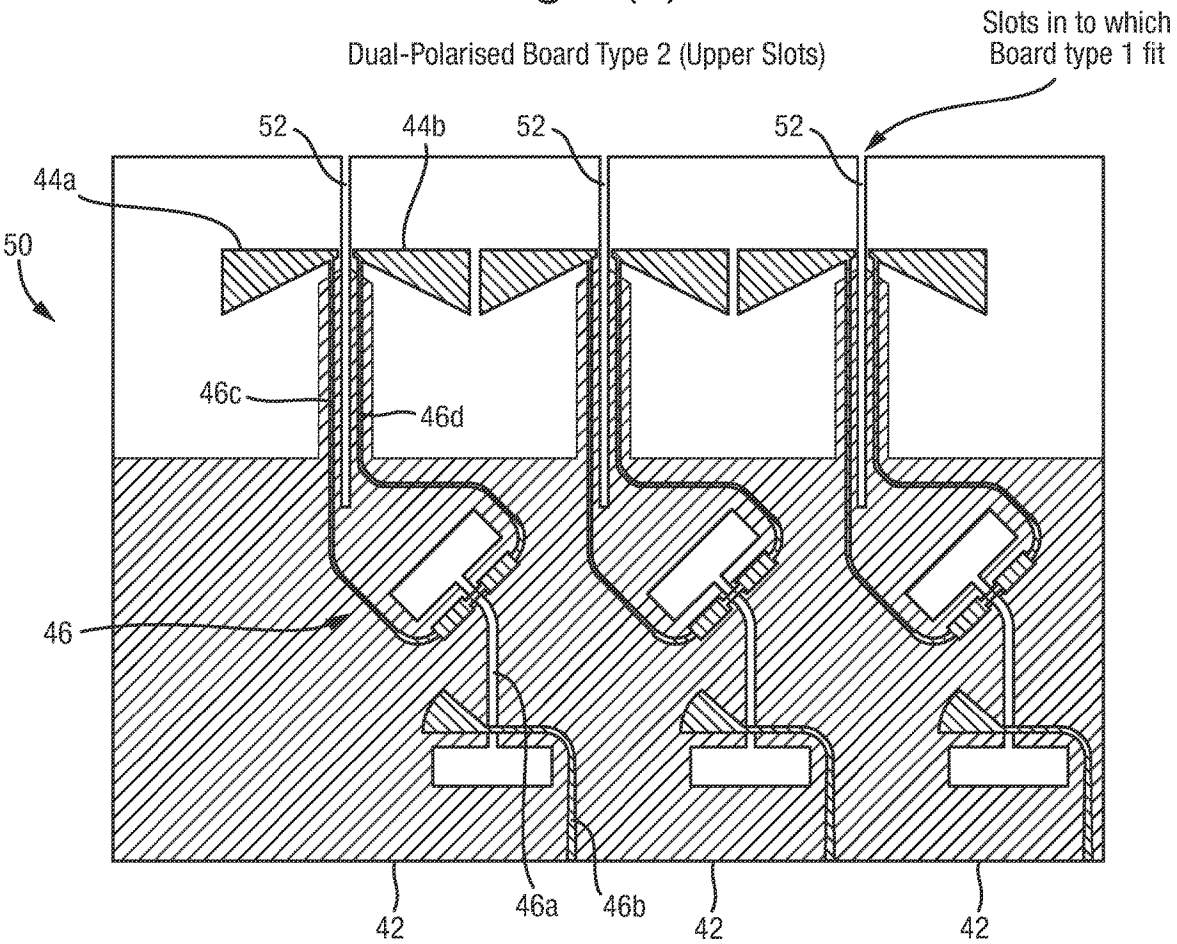

FIG. 1(*b*) shows a dual-polarised dipole antenna array, depicted generally at 11. The dual-dipole polarised antenna array 11 comprises an arrangement of a first group of dipole antenna sub-arrays 13 and a second group of dipole antenna sub-arrays 15. The dipole antenna sub-arrays 13, 15 each have a plurality of antenna units which have associated dipole arms. The first and second groups of dipole antenna sub-arrays are disposed in an orthogonal arrangement. The intersection of the orthogonal sub-arrays 13, 15 occurs at the centre of the radiating elements, maintaining co-incident phase centres for the two polarisations. This requires that the baluns of the antenna units are displaced laterally by half of an element spacing in order to avoid orthogonal boards dissecting the balun. The antenna array further comprises a ground plane 17. FIG. 4 shows in more detail suitable antenna sub-array arrangements. FIG. 4(*a*) shows the first dipole antenna sub-array 40 which includes a plurality of co-planar antenna units 42. Each antenna unit 42 includes a pair of dipole radiating elements 44(*a*), 44(*b*) which are of the bow tie type. Each antenna unit 42 further comprises a balun 46. The main elements of the baluns 46 are similar to the baluns 16 depicted in FIG. 1 in that each balun has a slotline 46(*a*) which is in communication with an input line 46(*b*) and an output line. The output line comprises first and second output arms 46(*c*), 46(*d*), each output arm 46(*c*), 46(*d*) having an output port which is in direct communication with one of the pair of dipole radiating elements 44(*a*), 44(*b*). The antenna units 42 each further comprise a slot 48, which extends into the antenna unit from the lower portion of the sub-array. The output section of the baluns 46 are each inclined with respect to the slot 48. In particular, the output arms 46(*c*), 46(*d*) and an upper section of the slotline 46(*a*) are inclined in this way. This makes it easier to maintain equal path lengths for the output arms 46(*c*), 46(*d*) between the baluns 46 and the two dipole radiating elements 44(*a*), 44(*b*).

FIG. 4(*b*) shows a second dipole antenna sub-array 50. The second dipole antenna sub-array 50 shares many common elements with the first dipole antenna sub-array 40, and identical numerals are used to denote such shared elements. The principal difference is that the dipole antenna sub-array 50 has slots 52 which extend into each antenna unit 42 from the top portion of the dipole antenna sub-array 50, the slots 52 extending between the dipole radiating elements 44(*a*), 44(*b*) of each antenna unit 42. A dipole antenna array can be constructed by slotting dipole antenna sub-arrays 40, 50 together in an orthogonal arrangement.

Figure 5:
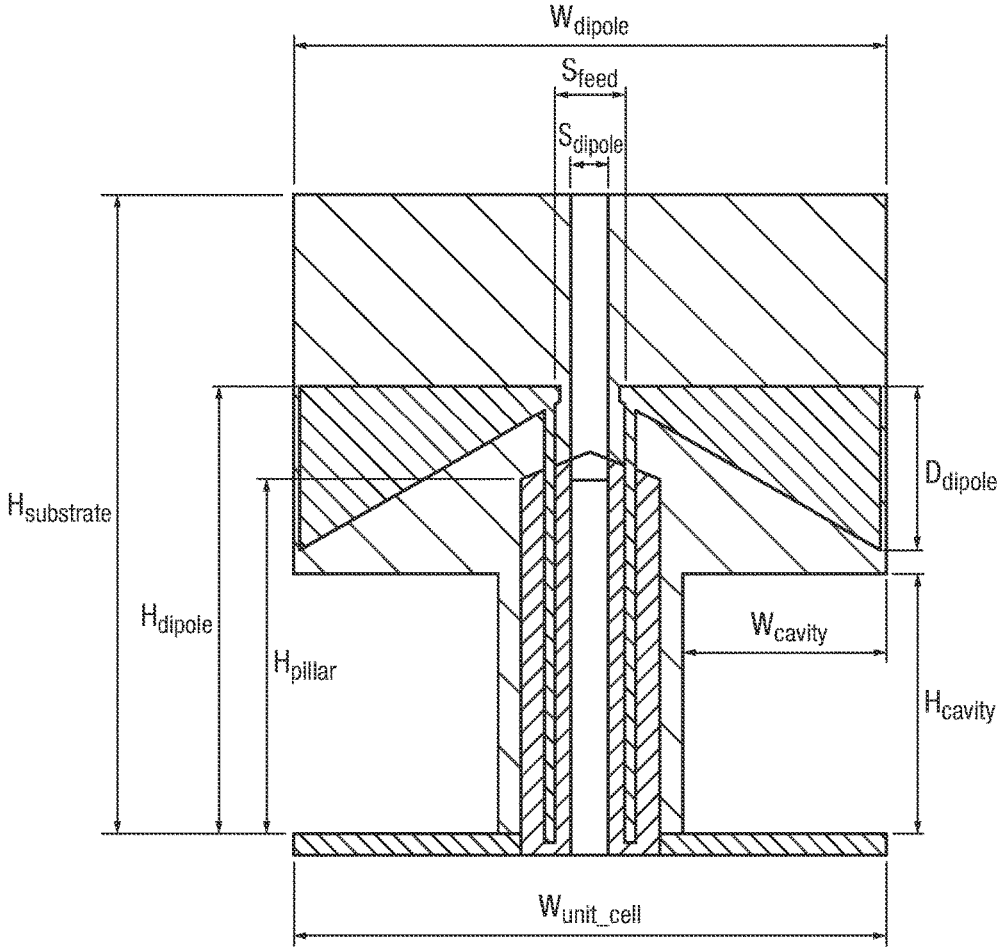
FIG. 5 shows design parameters for radiating elements.

FIG. 5 shows the primary design parameters identified for the radiating element based on the FIG. 1(*b*) arrangement in which the dipole radiating elements remain on the track layer. A bow-tie dipole radiating element shape has been assumed, although a small value $D_{dipole}$ would essentially give a standard dipole element. Here $W_{dipole}$ is less than $W_{unit_cell}$ but for an arrangement in which a radiating element is on the outside of a triplate laminate $W_{dipole}$ would be greater than $W_{unit_cell}$. It is possible that shapes other than bow-tie shape for the dipole element may be more suitable in the arrangement in which the dipole elements are on the outside of a triplate laminate. Typically, $H_{dipole}$ is $\lambda_{max}/10$ and $W_{unit_cell}$ is $\lambda min/2$, where the radiating element is operating in an array environment. The parameters $W_{cavity}$ and $H_{cavity}$ indicate an area of the triplate laminate that can optionally be removed between the dipole arms and the ground plane. Dipole antenna arrays of the type described herein are believed to be capable of operating over a 4:1 frequency range. With examples corresponding to the FIG. 1(*b*) arrangement operation at a lower, frequency of approximately 2.5 GHz and an upper frequency of approximately 13 GHz is possible.

The invention claimed is:

1. A dipole antenna array including at least one dipole antenna sub-array, wherein the dipole antenna sub-array includes a plurality of co-planar antenna units, each antenna unit including a pair of dipole radiating elements and a balun having a slotline in communication with an input line and an output line, the output line comprising a first output arm and a second output arm for providing output electrical signals to the pair of dipole radiating elements, wherein the first output arm and the second output arm each have an output port which is in direct communication with at least one of the pair of dipole radiating elements, wherein each antenna unit has a slot extending between its dipole radiating elements, and wherein the first output arm and the second output arm are inclined with respect to the slot to form a substantially straight line that is oblique to the slot.

2. The dipole antenna array according to claim 1 in which the dipole antenna sub-array has a first face and a second face, and at least two consecutive antenna units each having a dipole radiating element on both the first and second faces.

3. The dipole antenna array according to claim 2 in which consecutive antenna units are arranged so that a dipole radiating element on the first face of one of said consecutive antenna units is adjacent a dipole radiating element on the second face of the next one of said consecutive antenna units.

4. The dipole antenna array according to claim 3 in which the consecutive antenna units are arranged so that a dipole radiating element on the first face of one of said consecutive antenna units overlaps the adjacent dipole radiating element on the second face of the next one of said consecutive antenna units.

5. The dipole antenna array according to claim 1 further including a ground plane having at least one slot formed therein, wherein a dipole antenna sub-array extends through the slot.

6. The dipole antenna array according to claim 5 including a plurality of dipole antenna sub-arrays in which the ground plane includes a plurality of parallel slots formed therein, and the dipole antenna sub-arrays extend through the slots so that the dipole antenna sub-arrays are in a parallel arrangement.

7. The dipole antenna array according to claim 1 in which at least one of the input line and the output line is a microstrip or a stripline.

8. The dipole antenna array according to claim 1 in the form of a printed circuit board (PCB).

9. The dipole antenna array according to claim 8 in the form of a microwave laminate structure.

10. The dipole antenna array according to claim 1, wherein the slot extends into the antenna unit from a lower portion of the sub-array.

11. The dipole antenna array according to claim 1, wherein the first output arm and the second output arm are arranged on a same side of the slot.

12. A dual polarised dipole antenna array including at least first and second dipole antenna sub-arrays, wherein each dipole antenna sub-array includes a plurality of coplanar antenna units, each antenna unit including a pair of dipole radiating elements and a balun having a slotline in communication with an input line and an output line, the output line comprising a first output arm and a second output arm for providing output electrical signals to the pair of dipole radiating elements, and wherein the at least first and second dipole antenna sub-arrays are in a mutually orthogonal arrangement, wherein the first output arm and the second output arm each have an output port which is in direct communication with at least one of the pair of dipole radiating elements, wherein each antenna unit has a slot extending between its dipole radiating elements, and wherein the first output arm and the second output arm are inclined with respect to the slot to form a substantially straight line that is oblique to the slot.

13. The dipole antenna array according to claim 12 in which the first and second dipole antenna sub-arrays are separate elements conjoined together in the mutually orthogonal arrangement.

14. The dipole antenna array according to claim 13 in which the first and second dipole antenna sub-arrays are slotted together in the mutually orthogonal arrangement using a plurality of slots formed in at least one of the first and second dipole antenna sub-arrays.

15. The dipole antenna array according to claim 14 in which the first dipole antenna sub-array has slots formed therein, in which each slot extends between the dipole radiating elements of an antenna unit.

16. The dipole antenna array according to claim 15 in which each antenna unit which has a slot extending between its dipole radiating elements has its balun arranged so that at least the first output arm and the second output arm of the output line are inclined with respect to the slot.

17. The dipole antenna array according to claim 12, wherein the first output arm and the second output arm are arranged on a same side of the slot.

18. A dipole antenna sub-array for a dual polarised dipole antenna array, the sub-array including a plurality of coplanar antenna units, each antenna unit including a pair of dipole radiating elements and a balun having a slotline in communication with an input line and an output line, the output line comprising a first output arm and a second output arm for providing output electrical signals to the pair of dipole radiating elements, and wherein the dipole antenna sub-array has slots formed therein, in which each slot extends between the dipole radiating elements of an antenna unit, and wherein the first output arm and the second output arm are inclined with respect to the slot to form a substantially straight line that is oblique to the slot.

19. The dipole antenna sub-array according to claim 18 in which the baluns each include a slotline which is coupled to an input line and the output line.

20. The dipole antenna sub-array according to claim 18 in which at least one of the input line and the output line is a microstrip or a stripline.

21. The dipole antenna sub-array according to claim 18 in the form of a printed circuit board (PCB).

22. The dipole antenna sub-array according to claim 21 in the form of a microwave laminate structure.

* * * * *